US005399137A

United States Patent [19]

Kushner

[11] Patent Number: 5,399,137

[45] Date of Patent: Mar. 21, 1995

[54] FRICTION RESISTANCE EXERCISING DEVICE

[76] Inventor: Steve P. Kushner, P.O. Box 290923, Davie, Fla. 33329

[21] Appl. No.: 157,925

[22] Filed: Nov. 24, 1993

[51] Int. Cl.[6] ..... A63B 21/012

[52] U.S. Cl. ..... 482/114; 482/120; 482/131

[58] Field of Search ..... 482/114–116, 482/118–120, 131; 188/65.1, 65.2; 182/190, 192

[56] References Cited

U.S. PATENT DOCUMENTS

| | | | |
|---|---|---|---|
| 1,127,600 | 2/1915 | Custis | 474/186 |
| 1,572,802 | 2/1926 | Layman | 482/120 |
| 3,142,192 | 7/1964 | Edberg | 474/186 |
| 3,532,189 | 10/1970 | Wade | 482/120 |
| 3,608,900 | 9/1971 | Welch et al. . | |
| 3,614,098 | 10/1971 | Carr . | |
| 3,614,098 | 10/1971 | Carr | 482/120 |
| 3,731,921 | 5/1973 | Andrews, Jr. | 482/115 |
| 3,814,084 | 6/1974 | Gustafson . | |
| 4,060,240 | 11/1977 | Dunston | 482/131 |
| 4,540,172 | 9/1985 | Evans | 482/120 |
| 4,560,160 | 12/1985 | Smith | 482/120 |
| 5,176,602 | 1/1993 | Roberts . | |

FOREIGN PATENT DOCUMENTS

| | | | |
|---|---|---|---|
| 0389682 | 3/1933 | United Kingdom | 482/114 |

*Primary Examiner*—Richard J. Apley
*Assistant Examiner*—John Mulcahy
*Attorney, Agent, or Firm*—Herbert L. Lerner; Laurence A. Greenberg

[57] ABSTRACT

A frictional exercising device includes a shell body which can be attached to a substantially stationary object, for instance a door, a doorjamb or a floor. A core cylinder is rigidly mounted in the shell body. The core cylinder has a wall with an arcuate friction surface having bumps formed thereon. A space is defined between the friction surface and the shell body through which a flat strap extends. The flat strap is partially wound around the core cylinder and hugs the friction surface. When one of the ends of the flat strap is pulled and a resistive force is applied at the other end, a frictional force increases between the friction surface and the flat strap.

8 Claims, 1 Drawing Sheet

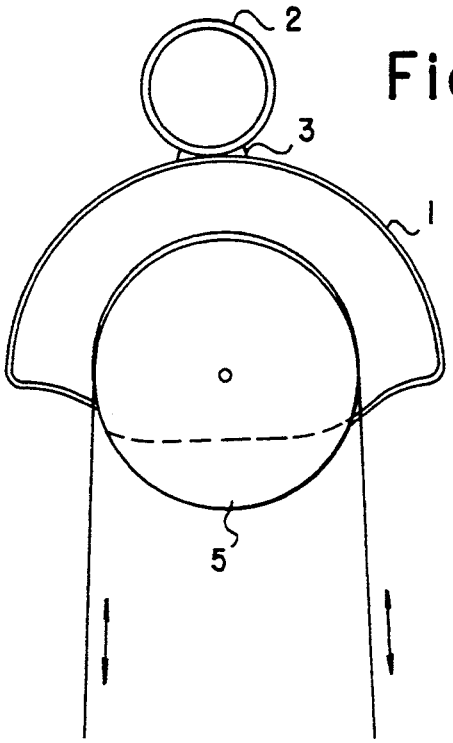
Fig.2
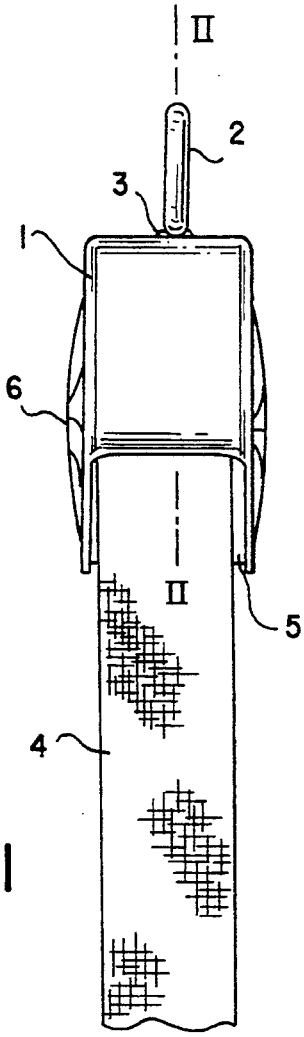
Fig.1
Fig.3
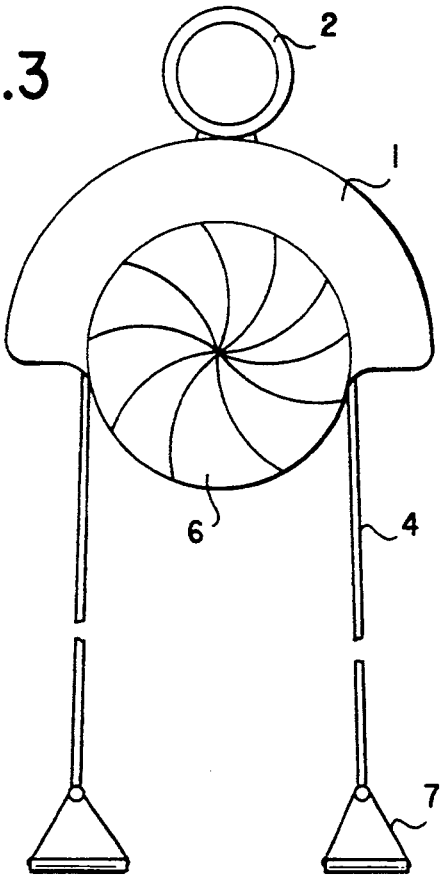
Fig.4
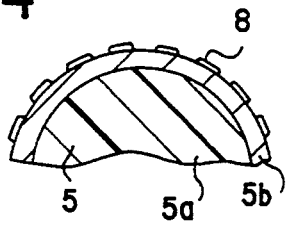
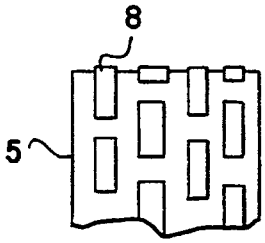
Fig.5

FRICTION RESISTANCE EXERCISING DEVICE

BACKGROUND OF THE INVENTION

1. Field of the Invention

The invention relates to an exercising device, more particularly a multi-purpose friction exercise device.

2. Description of the Related Art

A frictional resistance exercising device of this general kind is known from U.S. Pat. No. 3,614,098 to Byrle Carr. Handles are provided which are attached at the free ends of a rope. The rope is threaded through a central member with an out sleeve and a wedge-shaped hollow interior. The amount of friction acting on the rope as it is pulled through the central member may be adjusted. The adjustment is through a clamping of the rope between the wedge shaped member and the outer sleeve.

While the Carr device is quite versatile in its application to a number of different exercises, and while it provides adjustable resistance, the adjustability is not immediate and instantaneous. Instead, the exercise must be interrupted for the purpose of changing the frictional setting.

SUMMARY OF THE INVENTION

It is accordingly an object of the invention to provide an exercising device, which overcomes the hereinaforementioned disadvantages of the heretofore-known devices of this general type and which allows instantaneous and continuous adjustment thereof and which allows contiuous transitions between warm-up, isometric and isokinetic exercises.

With the foregoing and other objects in view there is provided, in accordance with the invention, an exercising device, comprising:

a shell body with attachment means for attaching the shell body to a substantially stationary object;

a core cylinder rigidly mounted in the shell body; the core cylinder having a wall with an arcuate friction surface; the friction surface and the shell body defining a space therebetween; and a flat strap having two ends and being partially wound around the core cylinder and hugging the friction surface, such that when one of the ends of the flat strap is pulled and a resistive force is applied at the other end, a frictional force results between the friction surface and the flat strap.

The frictional force which results from the pulling force and from the resistive force, is virtually a function of the resistive force. In other words, the harder the strap is held back, the more resistance is added in terms of the frictional resistance on the arcuate surface. In the static limit, the pulling force equals the resistive force plus the friction (negligible forces such as gravity are not considered).

In accordance with another feature of the invention, the core cylinder has a cylindrical wall and the arcuate friction surface is a partial or fully cylindrical friction surface.

In accordance with an added feature of the invention, the core cylinder is formed of a plastic core and a metallic sleeve disposed thereon.

In accordance with a further feature of the invention, the exercising device includes bumps formed on the arcuate friction surface for providing a resistive form-lock between the friction surface and the flat strap when the flat strap pulled.

In accordance with again another feature of the invention, the shell body, the attachment means and the core cylinder form an integral unit. If the materials are molded with plastic, it is even possible to form them in a single mold. In one preferred embodiment, one half of the shell body is formed together with the core cylinder and the attachment hook. A metallic cylinder (or similar shell, according to the cross section of the core cylinder) is then slipped onto the core cylinder. Finally, a lid is placed and glued or otherwise attached to the first half of the shell body.

In accordance with a concomitant feature of the invention, the shell body has openings formed therein for venting the core cylinder. In the preferred embodiment, these vent openings are defined by vanes disposed on at least one outer surface of the shell body. The vanes are means for allowing venting of the core cylinder and the air space between the friction surface and the inner wall surface of the shell body. Such a feature is advantageous, since the device is basically a friction resistor, in which kinetic energy is partially converted to heat energy.

The invention is primarily based on the realization that frictional forces are most accurately adjusted in "real time", i.e. during the exercise and, furthermore, that the frictional resistance of the device should be a function of the applied force. Power input, therefore, is directly translated into opposing power output, with a small fraction "lost" to frictional heating of the device.

The device functions with a mechanical resistance wide band (strap) hugging or rubbing against a cylindrical fixed part. The resistance is an exchange between muscles, pitting one group of muscles against another with the addition of the frictional force. It is not necessary to adjust the device mechanically.

Kinesthetic exercises are preferred on the device, namely Combined Bilateral Contraction (C.B.C.) or combined activities exercises for legs and arms. By increasing the conscious C.B.C. force against the friction surface, the force placed on opposing muscles increases.

A slight increase in effort increases the resistance on the opposing muscles "exponentially". This allows for quick changes in intensity. Therefore, warm-up, isometrics and isokinetics can all be performed in one motion. The preferred band width of 1-1½" allows all types of exercises.

Numerous types of exercises are recommended:

1. Warm-up-aerobic—continuous rhythmical movement.
2. Resistance training—muscle training.
   a) Isokinetic—Concentric or eccentric (positive or negative) contractions utilizing constant speed with variable resistance.
   b) Isometric—concentric contraction against a rigid object.
3. Stretching—the device can be used for a variety of static stretches.
4. Sports specific training—the device can be used to mimic many sports activities to produce increases in strength, speed, power and flexibility. Such sports are tennis, racquetball, boxing, swimming.
5. Special implications—exercises for handicapped persons, e.g. in a wheelchair; or in rehabilitation, e.g. rotary cuffs, etc.

In general application, warm-up, strength and power training can be done in a shorter time period than with any other training device. Workouts can be done in one third or even one fourth of the time.

Other features which are considered as characteristic for the invention are set forth in the appended claims.

Although the invention is illustrated and described herein as embodied in an exercising device, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 1 is a fragmentary, side-elevational view of the exercising device according to the invention;

FIG. 2 is a cross-sectional view taken along the line II—II in FIG. 1;

FIG. 3 is a front-elevational view of the device;

FIG. 4 is a fragmentary, cross-sectional view of a friction cylinder according to the invention; and FIG. 5 is a fragmentary side-elevational view of the friction cylinder.

DESCRIPTION OF THE PREFERRED EMBODIMENTS

Referring now to the figures of the drawing in detail and first, particularly, to FIG. 1 thereof, there is seen a shell body 1 with an attachment ring 2. The shell body 1 and the attachment ring 2 may be made out of plastic or metal. In the case of the latter, the ring 2 is welded to the shell body 1, as indicated by fillet weld spots 3. The ring 2 is defined as attachment means which attach the shell body 1 to a stationary object. This includes rigidly holding the shell body 1 on the floor or in a corner, behind or on a door jamb, and the like.

A flat strap or belt 4 extends through the shell body 1 and partially wraps around a core cylinder 5. The core cylinder 5 is non-rotatably fixed in the shell body 1. It is noted that the term "cylinder" is not necessarily used in the strict mathematical sense, but rather that any axle-type structure with a curved surface should be included in the definition. With reference to the dashed line in FIG. 1, the core cylinder 5 may also be a partial cylinder. The proper functionality of the device is assured if an arcuate friction surface is provided. In the preferred embodiment, this is a cylindrical friction surface hugged by the strap and upon which the strap 4 may slide.

The core cylinder 5 and the strap 4 define the essential structural and functional features of the invention. The core cylinder 5 is preferably formed of metal or of a plastic core with a metallic cylinder surface. The strap 4 is made of fabric, preferably of synthetic fiber material similar to seatbelt material. The surface structure of the core cylinder 5 and the material of the flat strap 4 are chosen such that (1) only very little resistance is provided when the strap 4 is pulled on one end and no counter force is applied at the other end and that (2) a great amount of resistance is provided when a strong counter force is applied to the other end. In fact, it has been found in experiments with the preferred embodiment that an increase in the "resistance force" is greater than the increase in the "pulling force". The resistance force, thereby, is defined as the arithmetic sum of the counter force applied by the (resistive) arm and the frictional force. The pulling force is equal to the force applied by the pulling arm. In the extreme, therefore, the resistive arm can easily stop the strap, because it is aided by the frictional resistance between the strap 4 and the cylinder 5. General mechanics provides additional information in this respect.

With reference to FIG. 3, vanes 6 are provided at the forward and rear faces of the shell body 1. The vanes 6, i.e. the openings in between the vanes 6, provide for proper airing of the core cylinder 5, so that any friction heat buildup may be quickly dissipated into ambient air. It is understood that, instead of vanes 6, the shell body 1 may be provided with spokes, round openings, mesh material or even arbitrarily distributed design features.

The ends of the flat strap 4 may be provided with handles 7 or any other attachment means. Due to the versatility of the device, it is possible to attach a handle (usably with hands or with feet) on the one end and a strap loop on the other end. The strap loop may, for instance, be attached around the waist, the ring 2 may be hooked in a rod on which the person stands, and the handle 7 may be grasped with both hands. In that configuration it would be possible to perform squat/curl exercises or front raise/upright row/curl exercises. In another configuration, it is possible to attach the loop to one ankle, while the ring 2 is attached, say, under a door. Combined leg, hip and arm exercises are thus possible. Any number of exercises and configurations are possible with the claimed device, as they will be obvious to the person skilled in the exercise arts.

With reference to FIGS. 4 and 5, raised portions or bumps 8 on the core cylinder 5 may be provided for adjusting the variable resistance of the device. In addition to the purely frictional forces between the strap 4 and the cylinder surface 5, a certain amount of form-lock may thus occur as the fabric of the strap 4 "hugs" to bumps 8. It is noted, in this context, that a form-locking connection is one which is connects two elements together due to the shape of the elements themselves, as opposed to a force-locking (frictional) connection, which locks the elements together by force external to the elements. It is quite evident that the fraction of form-lock increases, the more the strap fabric is pulled in between the bumps 8, i.e. the more pulling force and counter force is applied at the ends of the strap 4.

Also shown in FIG. 4 is a central plastic core 5*a* with a metallic cylinder sleeve 5*b*. The bumps 8 may be embossed in the sleeve 5*b*, they may be formed on, or they may be drip-coated thereon. Any other type of surface structuring is possible as well. Alternatively, the friction surface may also be of plastic, i.e. the surface structuring may be directly molded.

I claim:

1. An exercising device, comprising:

a shell body defining an interior space and having attachment means for attaching said shell body to a substantially stationary object; 'a core cylinder rigidly mounted in said interior space of said shell body, with said shell body surrounding a substantial portion of said core cylinder; said core cylinder having a wall with an arcuate friction surface; said friction surface and said shell body defining a space therebetween; and a flat strap having two ends and being partially wound around said core cylinder and hugging said friction surface, such that when one of the ends of said flat strap is pulled and a resistive force is applied at the other end, a frictional force results between said friction surface and said flat strap, which frictional force is a function of the resistive force; and bumps formed on said arcuate friction surface for providing a resistive form-lock between said friction surface and said flat strap when said flat strip is pulled, said bumps being formed of the same material as said core cylinder friction surface.

2. The exercising device according to claim 1, wherein said core cylinder has a cylindrical wall and said arcuate friction surface is a cylindrical friction surface.

3. The exercising device according to claim 2, wherein said core cylinder is formed of a plastic core and a metallic sleeve disposed thereon.

4. The exercising device according to claim 1, wherein said shell body, said attachment means and said core cylinder form an integral unit.

5. The exercising device according to claim 1, wherein said shell body has openings formed therein for venting said core cylinder.

6. The exercising device according to claim 1, including vanes disposed on at least one outer surface of said shell body, said vanes being means for allowing venting of said core cylinder.

7. The exercising device according to claim 1, wherein said shell body encloses more than half of said core cylinder.

8. The exercising device according to claim 1, wherein said bumps are embossed in the material of said friction surface.

* * * * *